US006158401A

United States Patent [19]

Bailey

[11] Patent Number: 6,158,401

[45] Date of Patent: Dec. 12, 2000

[54] METHOD OF OPERATING A FREE PISTON INTERNAL COMBUSTION ENGINE WITH PULSE COMPRESSION

[75] Inventor: Brett M. Bailey, Peoria, Ill.

[73] Assignee: Caterpillar Inc., Peoria, Ill.

[21] Appl. No.: 09/256,141

[22] Filed: Feb. 24, 1999

[51] Int. Cl.[7] ..... F02B 71/00

[52] U.S. Cl. ..... 123/46 SC

[58] Field of Search ..... 123/46 R, 46 SC

[56] References Cited

U.S. PATENT DOCUMENTS

| | | | |
|---|---|---|---|
| 3,182,895 | 5/1965 | Panhard | 123/46 |
| 3,606,591 | 9/1971 | Potma | 123/46 SC |
| 4,599,861 | 7/1986 | Beaumont | 60/595 |
| 4,705,460 | 11/1987 | Braun | 123/46 SC |
| 4,992,031 | 2/1991 | Sampo | 417/364 |
| 5,540,194 | 7/1996 | Adams | 123/46 R |
| 5,775,273 | 7/1998 | Beale | 123/46 B |

FOREIGN PATENT DOCUMENTS

| | | | |
|---|---|---|---|
| 0254353A1 | 7/1987 | European Pat. Off. | F02B 71/04 |
| 0 481 690 a2 | 4/1992 | European Pat. Off. . | |
| 0280200B1 | 6/1992 | European Pat. Off. | F02B 71/04 |
| 6814405 | 4/1970 | Netherlands | F02B 71/04 |
| 93/10341 | 5/1993 | WIPO | F02B 71/02 |
| 93/10342 | 5/1993 | WIPO | F02B 71/04 |
| 93/10343 | 5/1993 | WIPO | F02B 71/04 |
| 93/10344 | 5/1993 | WIPO | F02B 71/04 |
| 93/10345 | 5/1993 | WIPO | F02B 71/04 |
| WO 93/10345 | 5/1993 | WIPO . | |
| 96/3576A1 | 2/1996 | WIPO | F02B 71/04 |
| 96/32576 | 10/1996 | WIPO | F02B 71/04 |
| 98/54450 | 12/1998 | WIPO . | |
| WO 99/34100 | 7/1999 | WIPO . | |

OTHER PUBLICATIONS

Tu Dresden—publication date unknown—earliest date 1993—Dresden University in Germany.

Application Ser. No. 08/974,326, filed Nov. 19, 1997, entitled "Two Cycle Engine Having a Mono–Valve Integrated with a Fuel Injector".

Application Ser. No. 08/978,329 filed Nov. 25, 1997, entitled "Hydraulic Apparatus with Improved Accumulator for Reduced Pressure.."

Application Ser. No. 09/151,267 filed Sep. 11, 1998, entitled "Method for Operation of a Free Piston Engine".

Application Ser. No. 09/225,525 filed Jan. 4, 1999, entitled "Fuel Injector Assembly Tool and Method".

*Primary Examiner*—Marguerite McMahon
*Assistant Examiner*—Jason Benton
*Attorney, Agent, or Firm*—Todd T. Taylor

[57] ABSTRACT

A method of operating a free piston engine of the present invention provides a piston including a piston head reciprocally disposed within a combustion cylinder, a plunger head reciprocally disposed within a hydraulic cylinder, and a plunger rod interconnecting the piston head with the plunger head. The plunger head and the hydraulic cylinder define a variable volume pressure chamber on a side of the plunger head generally opposite the plunger rod. A supply of hydraulic fluid is pulsed from a high pressure hydraulic accumulator into the pressure chamber during a beginning portion of a compression stroke to cause the piston head to move toward a top dead center position. The high pressure hydraulic accumulator is then decoupled from the pressure chamber. A low pressure hydraulic accumulator is coupled with the pressure chamber during a remaining portion of the compression stroke, thereby allowing a relatively lower pressure hydraulic fluid to flow into the hydraulic cylinder as the piston head moves toward the top dead center position.

16 Claims, 6 Drawing Sheets

METHOD OF OPERATING A FREE PISTON INTERNAL COMBUSTION ENGINE WITH PULSE COMPRESSION

TECHNICAL FIELD

The present invention relates to free piston internal combustion engines, and, more particularly, to a method of operating a free piston internal combustion engine with a hydraulic power output.

BACKGROUND ART

Internal combustion engines typically include a plurality of pistons which are disposed within a plurality of corresponding combustion cylinders. Each of the pistons is pivotally connected to one end of a piston rod, which in turn is pivotally connected at the other end thereof with a common crankshaft. The relative axial displacement of each piston between a top dead center (TDC) position and a bottom dead center (BDC) position is determined by the angular orientation of the crank arm on the crankshaft with which each piston is connected.

A free piston internal combustion engine likewise includes a plurality of pistons which are reciprocally disposed in a plurality of corresponding combustion cylinders. However, the pistons are not interconnected with each other through the use of a crankshaft. Rather, each piston is typically rigidly connected with a plunger rod which is used to provide some type of work output. In a free piston engine with a hydraulic output, the plunger is used to pump hydraulic fluid which can be used for a particular application. Typically, the housing which defines the combustion cylinder also defines a hydraulic cylinder in which the plunger is disposed and an intermediate compression cylinder between the combustion cylinder and the hydraulic cylinder. The combustion cylinder has the largest inside diameter; the compression cylinder has an inside diameter which is smaller than the combustion cylinder; and the hydraulic cylinder has an inside diameter which is still yet smaller than the compression cylinder. A compression head which is attached to and carried by the plunger at a location between the piston head and plunger head has an outside diameter which is just slightly smaller than the inside diameter of the compression cylinder. A high pressure hydraulic accumulator which is fluidly connected with the hydraulic cylinder is pressurized through the reciprocating movement of the plunger during operation of the free piston engine. An additional hydraulic accumulator is selectively interconnected with the area in the compression cylinder to exert a relatively high axial pressure against the compression head and thereby move the piston head toward the top dead center position.

In a free piston engine with a hydraulic power output as described above, the pressure chamber in the hydraulic cylinder which carries the plunger is only connected with the high pressure hydraulic accumulator when the piston head is moving toward the bottom dead center position during a return stroke. During a compression stroke, only a low pressure hydraulic accumulator is connected with the pressure chamber in the hydraulic cylinder which carries the plunger. Since the high pressure fluid in the compression cylinder acts to move the piston head toward the top dead center position, and since the cross-sectional area of the plunger head is relatively small and hence does not proportionately significantly add a large amount of additional axial force to the plunger, the high pressure hydraulic accumulator is not connected with the pressure chamber in the hydraulic cylinder during the compression stroke to avoid bleeding off any of the pressure previously built up pressure in the high pressure hydraulic accumulator.

SUMMARY OF THE INVENTION

The present invention provides a method of operating a free piston engine in which a pulse of high pressure is sourced from a high pressure hydraulic accumulator to the hydraulic cylinder to in turn provide the piston head with enough kinetic energy to effect proper compression within the combustion chamber.

In one aspect of the method of operating a free piston engine of the present invention, a piston includes a piston head reciprocally disposed within a combustion cylinder, a plunger head reciprocally disposed within a hydraulic cylinder, and a plunger rod interconnecting the piston head with the plunger head. The plunger head and the hydraulic cylinder define a variable volume pressure chamber on a side of the plunger head generally opposite the plunger rod. A supply of hydraulic fluid is pulsed from a high pressure hydraulic accumulator into the pressure chamber during a beginning portion of a compression stroke to cause the piston head to move toward a top dead center position. The high pressure hydraulic accumulator is then decoupled from the pressure chamber. A low pressure hydraulic accumulator is coupled with the pressure chamber during a remaining portion of the compression stroke, thereby allowing a relatively lower pressure hydraulic fluid to flow into the hydraulic cylinder as the piston head moves toward the top dead center position.

An advantage of the present invention is that the fluid pressure in the pressure chamber in the hydraulic cylinder is used both to move the piston head to the top dead center position during a compression stroke and to pressurize the hydraulic accumulator during a return stroke.

Another advantage is that the same high pressure accumulator can be used both during the compression stroke and during the return stroke.

Yet another advantage is that only a pulse of high pressure energy is provided from the high pressure hydraulic accumulator during the compression stroke, and the high pressure hydraulic accumulator is pressurized during substantially all of the return stroke, thereby resulting in a net positive gain in the pressure in the high pressure hydraulic accumulator.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
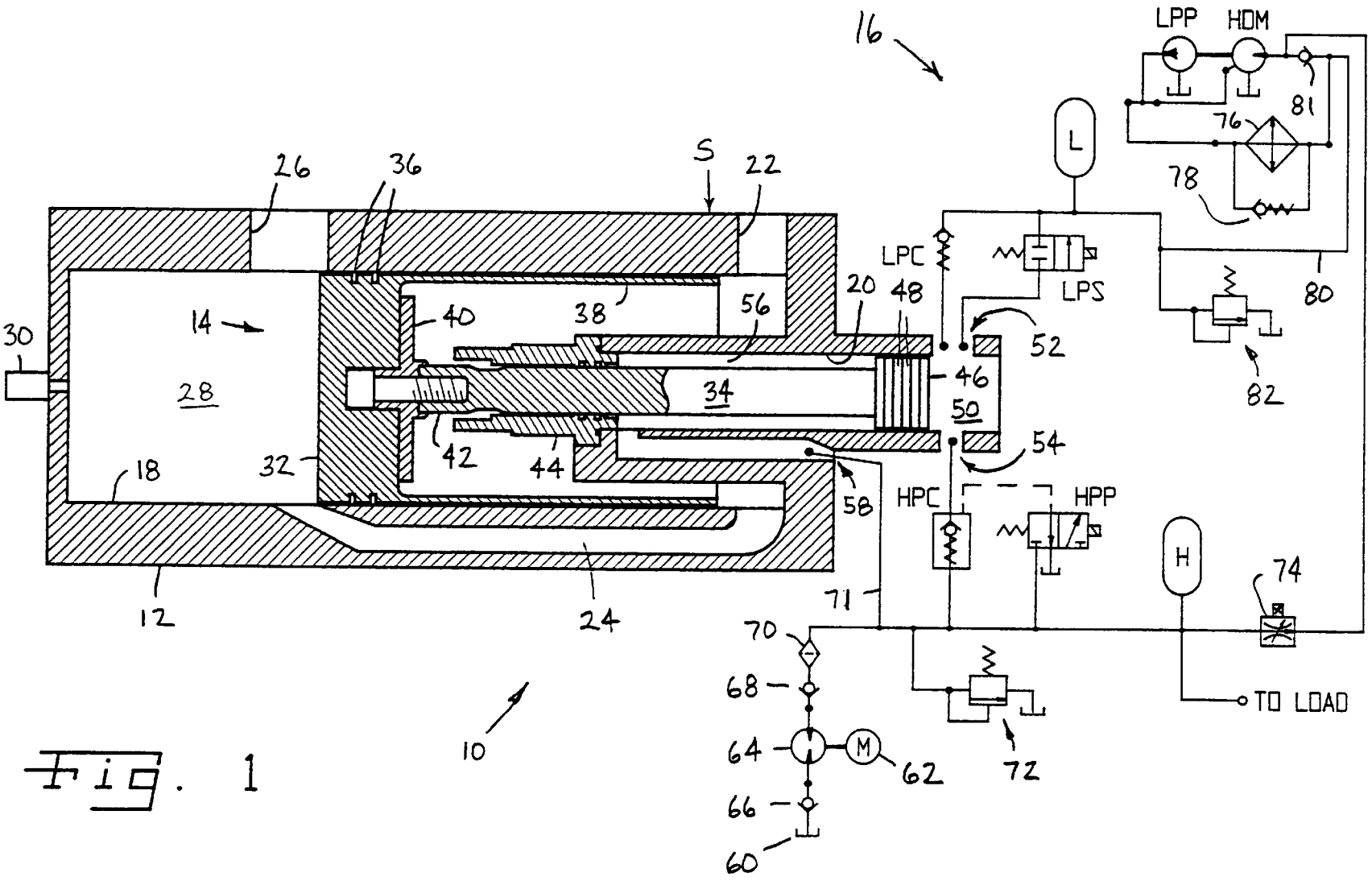
FIG. 1 is a schematic illustration of an embodiment of a free piston engine of the present engine.

Referring now to the drawings, and more particularly to FIG. 1, there is shown an embodiment of a free piston internal combustion engine 10 of the present invention which generally includes a housing 12, piston 14, and hydraulic circuit 16.

Housing 12 includes a combustion cylinder 18 and a hydraulic cylinder 20. Housing 12 also includes a combustion air inlet 22, air scavenging channel 24 and exhaust outlet 26 which are disposed in communication with a combustion chamber 28 within combustion cylinder 18. Combustion air is transported through combustion air inlet 22 and air scavenging channel 24 into combustion chamber 28 when piston 14 is at or near a BDC position. An appropriate fuel, such as a selected grade of diesel fuel, is injected into combustion chamber 28 as piston 14 moves toward a TDC position using a controllable fuel injector system, shown schematically and referenced as 30. The stroke length of piston 14 between a BDC position and a TDC position may be fixed or variable.

Piston 14 is reciprocally disposed within combustion cylinder 18 and is moveable during a compression stroke toward a TDC position and during a return stroke toward a BDC position. Piston 14 generally includes a piston head 32 which is attached to a plunger rod 34. Piston head 32 is formed from a metallic material in the embodiment shown, such as aluminum or steel, but may be formed from another material having suitable physical properties such as coefficient of friction, coefficient of thermal expansion and temperature resistance. For example, piston head 32 may be formed from a non-metallic material such as a composite or ceramic material. More particularly, piston head 32 may be formed from a carbon-carbon composite material with carbon reinforcing fibers which are randomly oriented or oriented in one or more directions within the carbon and resin matrix.

Piston head 32 includes two annular piston ring groves 36 in which are disposed a pair of corresponding piston rings (not numbered) to prevent blow-by of combustion products on the return stroke of piston 14 during operation. If piston head 32 is formed from a suitable non-metallic material having a relatively low coefficient of thermal expansion, it is possible that the radial operating clearance between piston head 32 and the inside surface of combustion cylinder 18 may be reduced such that piston ring grooves 36 and the associated piston rings may not be required. Piston head 32 also includes an elongated skirt 38 which lies adjacent to and covers exhaust outlet 26 when piston 14 is at or near a TDC position, thereby preventing combustion air which enters through combustion air inlet 22 from exiting out exhaust outlet 26.

Plunger rod 34 is substantially rigidly attached to piston head 32 at one end thereof using a mounting hub 40 and a bolt 42. Bolt 42 extends through a hole (not numbered) in mounting hub 40 and is threadingly engaged with a corresponding hole formed in the end of plunger rod 34. Mounting hub 40 is then attached to the side of piston head 32 opposite combustion chamber 28 in a suitable manner, such as by using bolts, welding, and/or adhesive, etc. A seal 44 surrounding plunger rod 34 and carried by housing 12 separates combustion cylinder 18 from hydraulic cylinder 20.

Plunger head 46 is substantially rigidly attached to an end of plunger rod 34 opposite from piston head 32. Reciprocating movement of piston head 32 between a BDC position and a TDC position, and vice versa, causes corresponding reciprocating motion of plunger rod 34 and plunger head 46 within hydraulic cylinder 20. Plunger head 46 includes a plurality of sequentially adjacent lands and valleys 48 which effectively seal with and reduce friction between plunger head 46 and an inside surface of hydraulic cylinder 20.

Plunger head 46 and hydraulic cylinder 20 define a variable volume pressure chamber 50 on a side of plunger head 46 generally opposite from plunger rod 34. The volume of pressure chamber 50 varies depending upon the longitudinal position of plunger head 46 within hydraulic cylinder 20. A fluid port 52 and a fluid port 54 are fluidly connected with variable volume pressure chamber 50. An annular space 56 surrounding plunger rod 34 is disposed in fluid communication with a fluid port 58 in housing 12. Fluid is drawn through fluid port 58 into annular space 56 upon movement of plunger rod 34 and plunger head 46 toward a BDC position so that a negative pressure is not created on the side of plunger head 46 opposite variable volume pressure chamber 50. The effective cross-sectional area of pressurized fluid acting on plunger head 46 within variable volume pressure chamber 50 compared with the effective cross-sectional area of pressured fluid acting on plunger head 46 within annular space 56, is a ratio of between approximately 5:1 to 30:1. In the embodiment shown, the ratio between effective cross-sectional areas acting on opposite sides of plunger head 46 is approximately 20:1. This ratio has been found suitable to prevent the development of a negative pressure within annular space 56 upon movement of plunger head 46 toward a BDC position, while at the same time not substantially adversely affecting the efficiency of free piston engine 10 while plunger head 46 is traveling toward a TDC position.

Hydraulic circuit 16 is connected with hydraulic cylinder 20 and provides a source of pressurized fluid, such as hydraulic fluid, to a load for a specific application, such as a hydrostatic drive unit (not shown). Hydraulic circuit 16 generally includes a high pressure hydraulic accumulator (H), a low pressure hydraulic accumulator (L), and suitable valving, etc. used to connect high pressure hydraulic accumulator H and low pressure hydraulic accumulator L with hydraulic cylinder 20 at selected points in time as will be described in greater detail hereinafter.

More particularly, hydraulic circuit 16 receives hydraulic fluid from a source 60 to initially charge high pressure hydraulic accumulator H to a desired pressure. A starter motor 62 drives a fluid pump 64 to pressurize the hydraulic fluid in high pressure hydraulic accumulator H. The hydraulic fluid transported by pump 64 flows through a check valve 66 on an input side of pump 64, and a check valve 68 and filter 70 on an output side of pump 64. The pressure developed by pump 64 also pressurizes annular space 56 via the interconnection with line 71 and fluid port 58. A pressure relief valve 72 ensures that the pressure within high pressure hydraulic accumulator H does not exceed a threshold limit.

The high pressure hydraulic fluid which is stored within high pressure hydraulic accumulator H is supplied to a load suitable for a specific application, such as a hydrostatic drive unit. The high pressure within high pressure hydraulic accumulator H is initially developed using pump 64, and is thereafter developed and maintained using the pumping action of free piston engine 10.

A proportional valve 74 has an input disposed in communication with high pressure hydraulic accumulator H, and provides the dual functionality of charging low pressure hydraulic accumulator L and providing a source of fluid power for driving ancillary mechanical equipment on free piston engine 10. More particularly, proportional valve 74 provides a variably controlled flow rate of high pressure hydraulic fluid from high pressure hydraulic accumulator H to a hydraulic motor (HDM). Hydraulic motor HDM has a rotating mechanical output shaft which drives ancillary equipment on free piston engine 10 using a belt and pulley arrangement, such as a cooling fan, alternator and water pump. Of course, the ancillary equipment driven by hydraulic motor HDM may vary from one application to another.

Hydraulic motor HDM also drives a low pressure pump (LPP) which is used to charge low pressure hydraulic accumulator L to a desired pressure. Low pressure pump LPP has a fluid output which is connected in parallel with each of a heat exchanger 76 and a check valve 78. If the flow rate through heat exchanger 76 is not sufficient to provide an adequate flow for a required demand, the pressure differential on opposite sides of check valve 78 causes check valve 78 to open, thereby allowing hydraulic fluid to by-pass heat exchanger 76 temporarily. If the pressure developed by low pressure pump LPP which is present in line 80 exceeds a threshold value, check valve 81 opens to allow hydraulic fluid to bleed back to the input side of hydraulic motor HDM. A pressure relief valve 82 prevents the hydraulic fluid within line 80 from exceeding a threshold value.

Low pressure hydraulic accumulator L selectively provides a relatively lower pressure hydraulic fluid to pressure chamber 50 within hydraulic cylinder 20 using a low pressure check valve (LPC) and a low pressure shutoff valve (LPS). Conversely, high pressure hydraulic accumulator H provides a higher pressure hydraulic fluid to pressure chamber 50 within hydraulic cylinder 20 using a high pressure check valve (HPC) and a high pressure pilot valve (HPP).

During an initial startup phase of free piston engine 10, starter motor 62 is energized to drive pump 64 and thereby pressurize high pressure hydraulic accumulator H to a desired pressure. Since piston 14 may not be at a position which is near enough to the BDC position to allow effective compression during a compression stroke, it may be necessary to effect a manual return procedure of piston 14 to a BDC position. To wit, low pressure shutoff valve LPS is opened using a suitable controller to minimize the pressure on the side of hydraulic plunger 46 which is adjacent to pressure chamber 50. Since annular space 56 is in communication with high pressure hydraulic accumulator H, the pressure differential on opposite sides of hydraulic plunger 46 causes piston 14 to move toward the BDC position, as shown in FIG. 1.

When piston 14 is at a position providing an effective compression ratio within combustion chamber 28, high pressure pilot valve HPP is actuated using a controller to manually open high pressure check valve HPC, thereby providing a pulse of high pressure hydraulic fluid from high pressure hydraulic accumulator into pressure chamber 50. Low pressure check valve LPC and low pressure shutoff valve LPS are both closed when the pulse of high pressure hydraulic fluid is provided to pressure chamber 50. The high pressure pulse of hydraulic fluid causes plunger head 46 and piston head 32 to move toward the TDC position. Because of the relatively large ratio difference in cross-sectional areas on opposite sides of plunger head 46, the high pressure hydraulic fluid which is present within annual space 56 does not adversely interfere with the travel of plunger head 46 and piston head 32 toward the TDC position. The pulse of high pressure hydraulic fluid is applied to pressure chamber 50 for a period of time which is sufficient to cause piston 14 to travel with a kinetic energy which will effect combustion within combustion chamber 28. The pulse may be based upon a time duration or a sensed position of piston head 32 within combustion cylinder 18.

As plunger head 46 travels toward the TDC position, the volume of pressure chamber 50 increases. The increased volume in turn results in a decrease in the pressure within pressure chamber 50 which causes high pressure check valve HPC to close and low pressure check valve LPC to open. The relatively lower pressure hydraulic fluid which is in low pressure hydraulic accumulator L thus fills the volume within pressure chamber 50 as plunger head 46 travels toward the TDC position. By using only a pulse of pressure from high pressure hydraulic accumulator H during a beginning portion of the compression stroke (e.g., during 60% of the stroke length), followed by a fill of pressure chamber 50 with a lower pressure hydraulic fluid from low pressure hydraulic accumulator L, a net resultant gain in pressure within high pressure hydraulic accumulator H is achieved.

By properly loading combustion air and fuel into combustion chamber 28 through air scavenging channel 24 and fuel injector 30, respectively, proper combustion occurs within combustion chamber 28 at or near a TDC position. As piston 14 travels toward a BDC position after combustion, the volume decreases and pressure increases within pressure 50. The increasing pressure causes low pressure check valve LPC to close and high pressure check valve HPC to open. The high pressure hydraulic fluid which is forced through high pressure check valve during the return stroke is in communication with high pressure hydraulic accumulator H, resulting in a net positive gain in pressure within high pressure hydraulic accumulator H.

Figure 2:
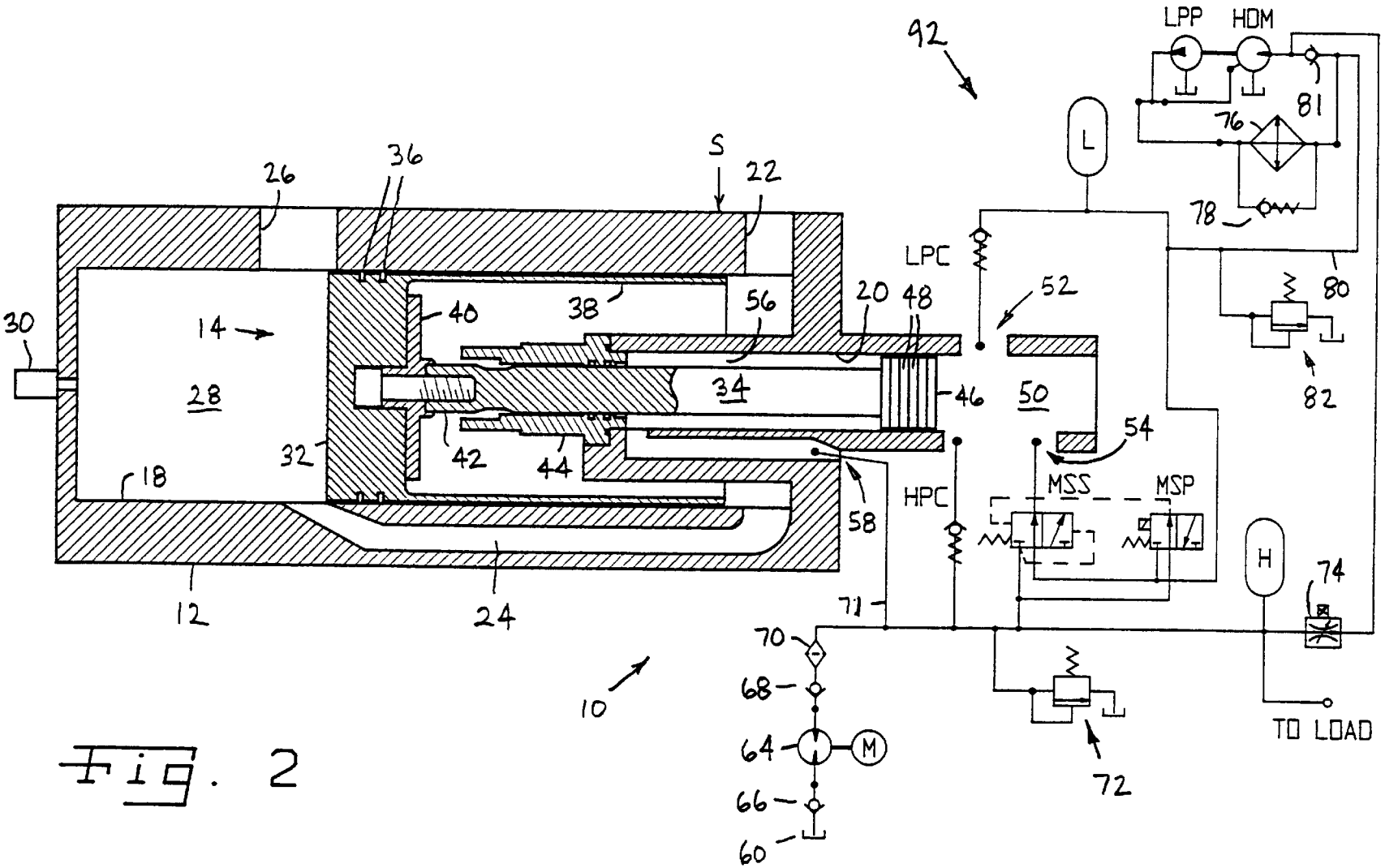
FIG. 2 is a schematic illustration of another embodiment of a free piston engine of the present engine.

FIG. 2 illustrates another embodiment of a free piston internal combustion engine 90 of the present invention, including a combustion cylinder and piston arrangement which is substantially the same as the embodiment shown in FIG. 1. Hydraulic circuit 92 of free piston engine 90 also includes many hydraulic components which are the same as the embodiment of hydraulic circuit 16 shown in FIG. 1. Hydraulic circuit 92 principally differs from hydraulic circuit 16 in that hydraulic circuit 92 includes a mini-servo valve 94 with a mini-servo main spool (MSS) and a mini-servo pilot (MSP). Mini-servo main spool MSS is controllably actuated at selected points in time during operation of free piston engine 90 to effect the high pressure pulse of high pressure hydraulic fluid from high pressure hydraulic accumulator H, similar to the manner described above with regard to the embodiment shown in FIG. 1. Mini-servo pilot MSP is controllably actuated to provide the pressure necessary for controllably actuating mini-servo main spool MSS. The pulse of high pressure hydraulic fluid is provided to pressure chamber 50 for a duration which is either dependent upon time or a sensed position of piston 14. As the volume within pressure chamber 50 increases, the pressure correspondingly decreases, resulting in an opening of low pressure check valve LPC. Low pressure hydraulic fluid from low pressure hydraulic accumulator L thus flows into pressure chamber 50 during the compression stroke of piston 14. After combustion and during the return stroke of piston 14, the pressure within pressure chamber 50 increases, thereby causing low pressure check valve LPC to close and high pressure check valve HPC to open. The high pressure hydraulic fluid created within pressure chamber 50 during the return stroke of piston 14 is pumped through high pressure check valve HPC and into high pressure hydraulic accumulator H, thereby resulting in a net positive gain in the pressure within high pressure hydraulic accumulator H.

Figure 3:
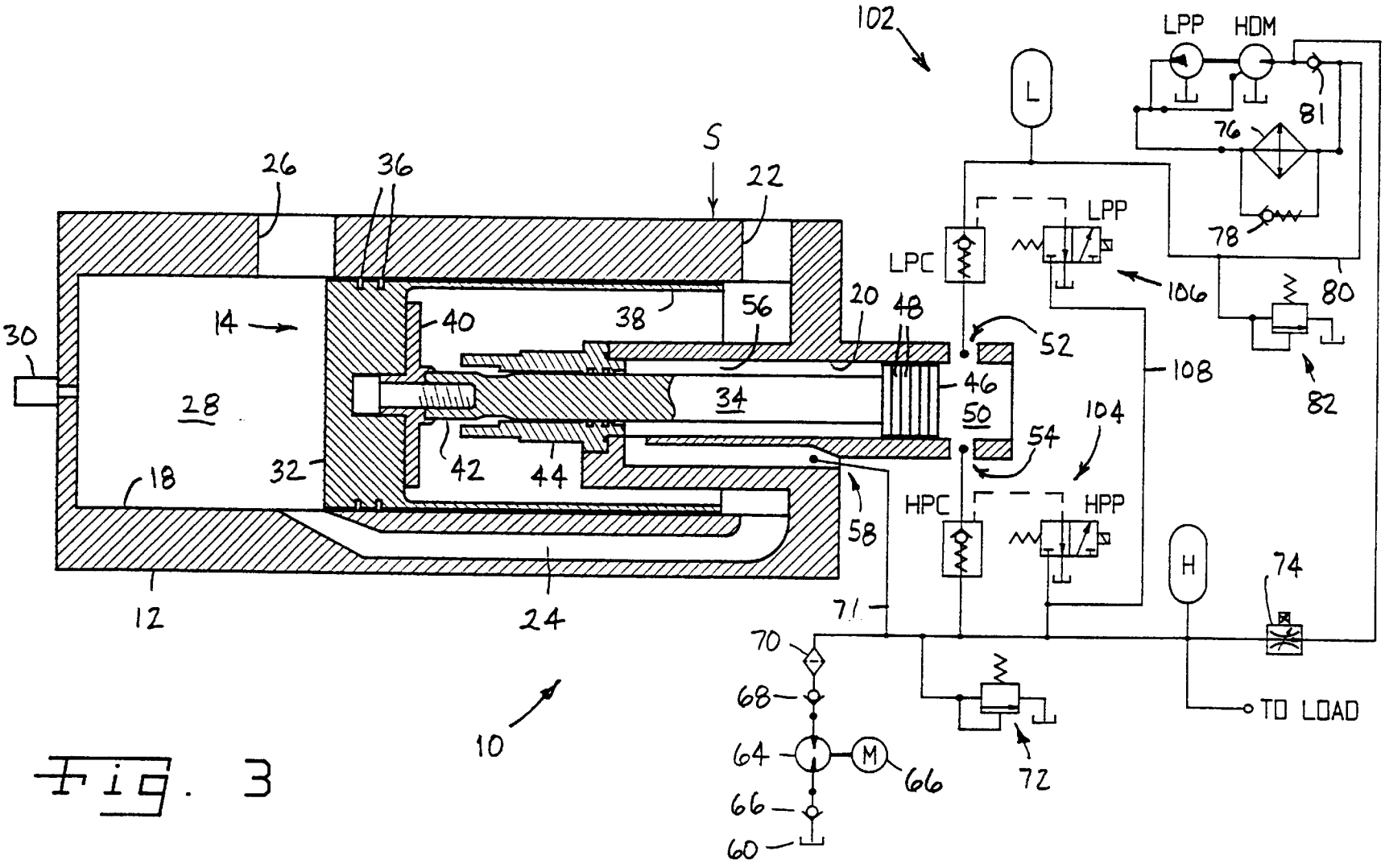
FIG. 3 is a schematic illustration of yet another embodiment of a free piston engine of the present engine.

Referring now to FIG. 3 there is shown yet another embodiment of a free piston engine 100 of the present invention. Again, the arrangement of combustion cylinder 18 and piston 14 is substantially the same as the embodiment of free piston engines 10 and 90 shown in FIGS. 1 and 2. Hydraulic circuit 102 also likewise includes many hydraulic components which are the same as the embodiments of hydraulic circuits 16 and 92 shown in FIGS. 1 and 2. However, hydraulic circuit 102 includes two pilot operated check valves 104 and 106. Pilot operated check valve 104 includes a high pressure check valve (HPC) and a high pressure pilot valve (HPP) which operate in a manner similar to high pressure check valve HPC and high pressure pilot valve HPP described above with reference to the embodiment shown in FIG. 1. Pilot operated check valve 106 includes a low pressure check valve (LPC) and a low pressure pilot valve (LPP) which also work in a manner similar to high pressure check valve 104. The input side of low pressure pilot valve LPP is connected with the high pressure fluid within high pressure hydraulic accumulator H through line 108. Low pressure pilot valve LPP may be controllably actuated using a controller to provide a pulse of pressurized fluid to low pressure check valve LPC which is sufficient to open low pressure check valve LPC.

During use, a pulse of high pressure hydraulic fluid may be provided to pressure chamber 50 using pilot operated check valve 104 to cause piston 14 to travel toward a TDC position with enough kinetic energy to effect combustion. High pressure pilot valve HPP is deactuated, dependent upon a period of time or a sensed position of piston 14, to thereby allow high pressure check valve HPC to close. As plunger head 46 moves toward the TDC position, the pressure within pressure chamber 50 decreases and low pressure check valve LPC is opened. Low pressure hydraulic fluid thus fills the volume within pressure chamber 50 while the volume within pressure chamber 50 expands. After combustion, piston 14 moves toward a BDC position which causes the pressure within pressure chamber 50 to increase. The increase causes low pressure check valve LPC to close and high pressure check valve to open. The high pressure hydraulic fluid which is generated by the pumping action of plunger head 46 within hydraulic cylinder 20 flows into high pressure hydraulic accumulator H, resulting in a net positive gain in the pressure within high pressure hydraulic accumulator H. A sensor (schematically illustrated and positioned at S) detects piston 14 near a BDC position. The high pressure pulse to effect the compression stroke can be timed dependent upon the sensor activation signal.

To effect a manual return procedure using the embodiment of free piston engine 100 shown in FIG. 3, high pressure hydraulic fluid is provided into annular space 56 from high pressure hydraulic accumulator H. Low pressure pilot valve LPP is controllably actuated to cause low pressure check valve LPC to open. The pressure differential on opposite sides of plunger head 46 causes piston 14 to move toward a BDC position. When piston 14 is at a position providing an effective compression ratio to effect combustion within combustion chamber 28, a high pressure pulse of hydraulic fluid is transported into pressure chamber 50 using pilot operated check valve 104 to begin the compression stroke of piston 14.

In the embodiment shown in FIGS. 1–3 and described above, piston 14 includes a plunger rod 34 having a plunger head 46 which is monolithically formed therewith. However, it is also possible that plunger head 46 may be separate from and attached to plunger rod 34.

Figure 4:
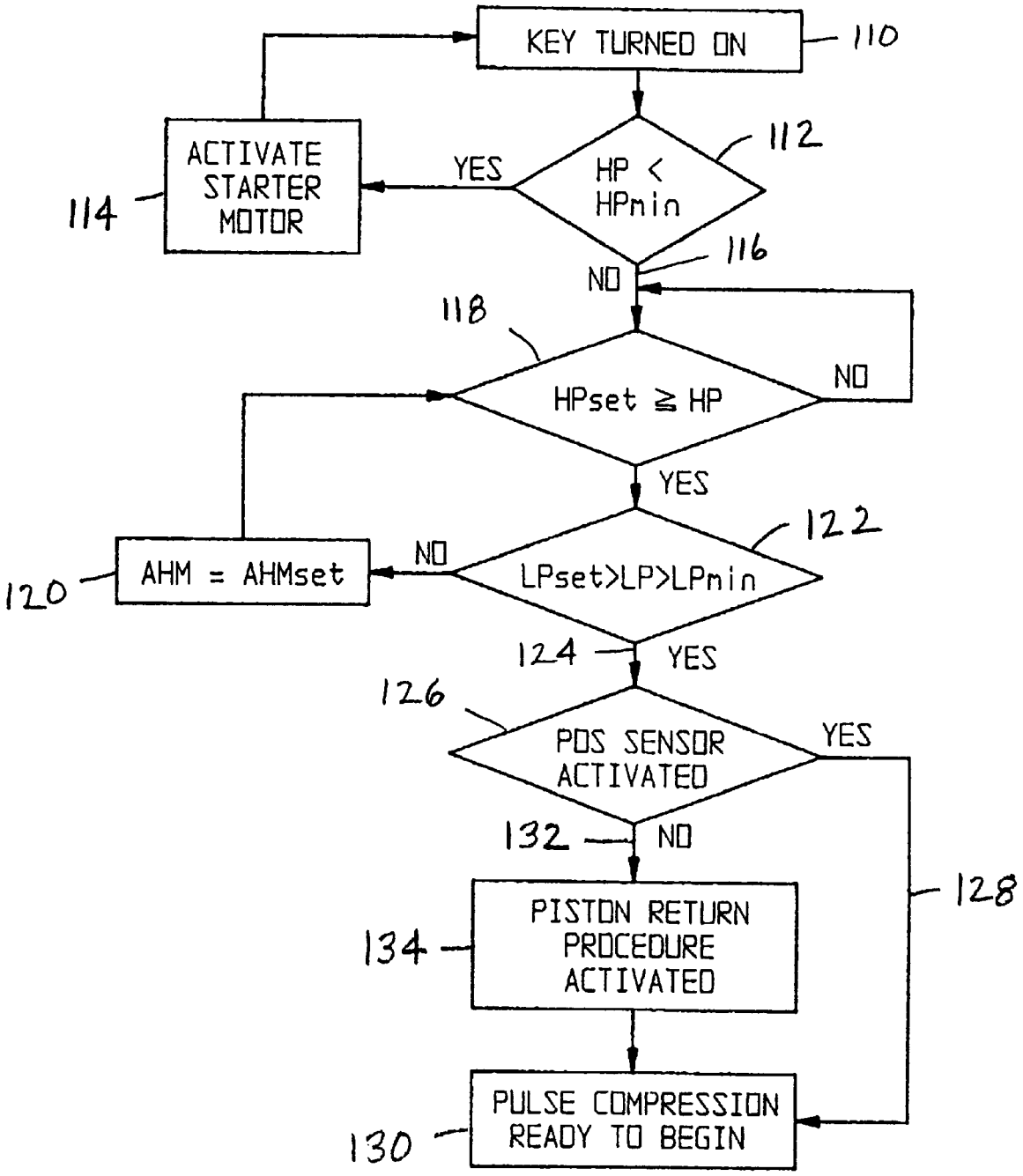
FIG. 4 is flow chart illustrating an embodiment of a method of the present invention for starting the free piston engine shown in FIG. 1.
Figure 5:
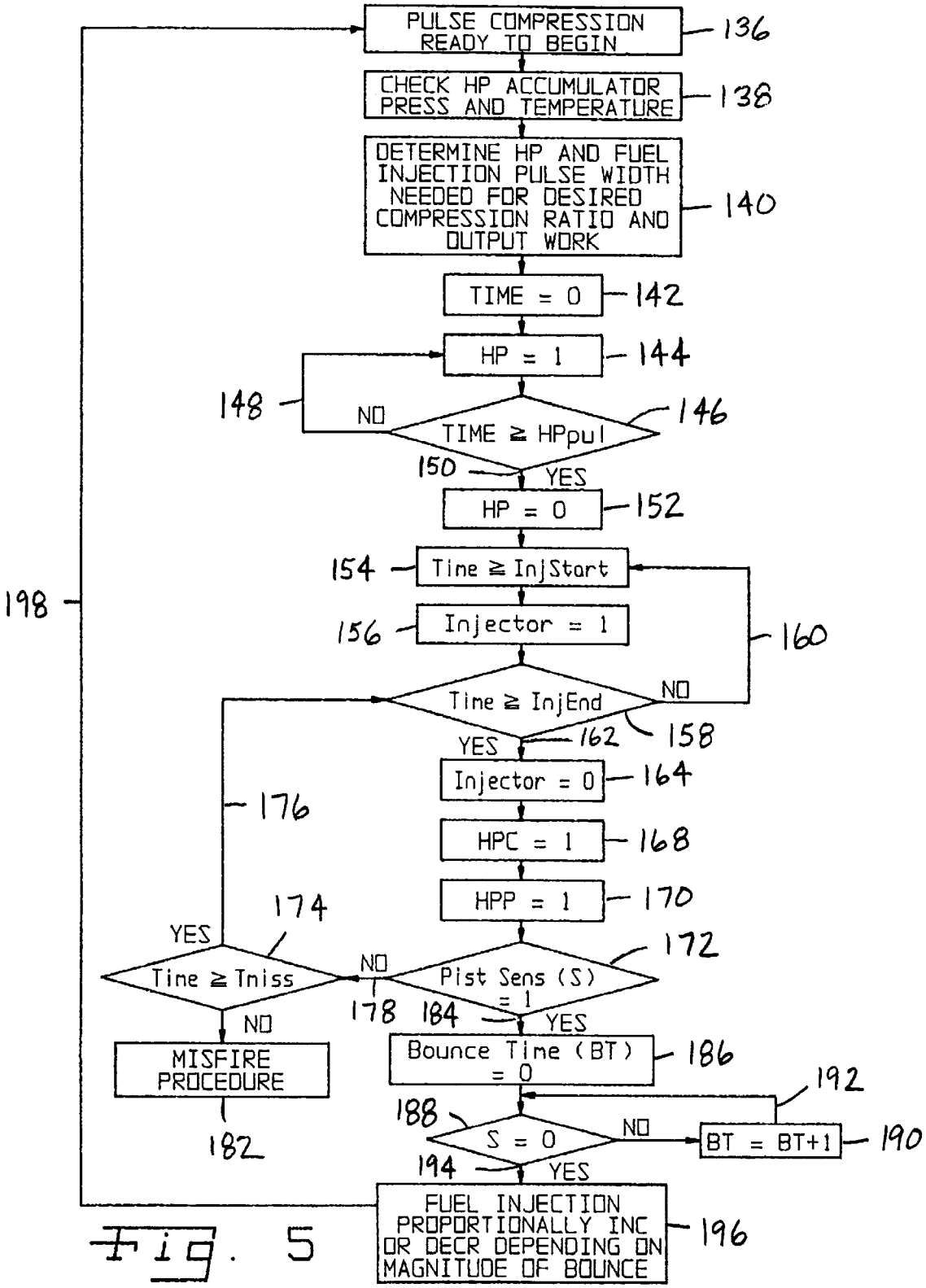
FIG. 5 is a flow chart illustrating an embodiment of a method of the present invention for operating the free piston internal combustion engine of FIG. 1.

Referring now to FIGS. 4 and 5, a method of the present invention for starting and operating free piston engine 10 shown in FIGS. 1–3 will be described in greater detail. The method of starting and operating free piston engine 10 is shown and will be described with particular reference to hydraulic circuit 16 shown in FIG. 1. However, the method of starting free piston engine 10 (FIG. 4) and operating free piston engine 10 (FIG. 5) may easily be used with hydraulic circuits 92 and 102 with only slight modifications which will be readily appreciated by those skilled in the art.

Referring to FIG. 4, the method of starting free piston engine 10 begins with turning the ignition key ON (block 110). The pressure HP within high pressure hydraulic accumulator H is sensed to determine whether the pressure is high enough for firing free piston engine 10 (decision block 112). If the pressure HP is less than a minimum pressure, $HP_{min}$, starter motor M is activated to drive pump 64 and thereby pressurize high pressure hydraulic accumulator H (block 114). The control loops between blocks 110, 112 and 114 until the pressure HP within high pressure hydraulic accumulator H is greater than the minimum pressure for firing free piston engine 10, designated $HP_{min}$ (line 116). In decision box 118, the value of the pressure within high pressure hydraulic accumulator H is also compared with a maximum threshold pressure value $HP_{set}$. If the pressure HP is also greater than the maximum threshold $HP_{set}$, the result from decision block 118 is NO and control loops back to decision block 112. On the other hand, if the pressure HP is less than the maximum threshold pressure $HP_{set}$, then the pressure within high pressure hydraulic accumulator H is satisfactory and the pressure LP within low pressure hydraulic accumulator L is sensed. If the pressure LP within low pressure hydraulic accumulator L is not greater than a minimum threshold pressure $LP_{min}$ and less than a maximum threshold pressure $LP_{set}$, then an auxiliary hydraulic motor AHM (referenced HDM1 in FIG. 1) is adjusted based upon the sensed speed (block 120). On the other hand, if the sensed pressure LP is greater than the minimum threshold pressure $LP_{min}$ and less than the maximum threshold pressure $LP_{set}$ (line 124), then a query is made as to whether the sensor S has been activated to indicate that piston 14 is at or near a BDC position (decision block 126). If the result from decision block 126 is YES (line 128), the pressures within high pressure hydraulic accumulator H and low pressure hydraulic accumulator L are within acceptable ranges and piston 14 is in a position allowing free piston engine 10 to be fired (block 130). On the other hand, if sensor S is not activated, piston 14 is not near enough to the BDC position to allow free piston engine 10 to be fired (line 132). A manual return procedure of piston 14 is then effected by opening low pressure shutoff valve LPS and applying a high pressure fluid to the annular space 56 to cause piston 14 to move to the BDC position, as described more fully above (block 134). After the manual return procedure, free piston engine 10 is then ready to fire (block 130).

Referring now to FIG. 5, a method of operating free piston engine 10 during normal operation will be described in greater detail. After the engine startup sequence has been completed and the free piston engine 10 is ready to fire (block 136), the pressure and temperature of the high pressure fluid HP within high pressure hydraulic accumulator H is checked (block 138). The pulse width of both the fuel pulse which is injected into combustion chamber 28 using fuel injector 30 as well as the pulse width of the high pressure fluid HP pulse which is injected into pressure chamber 50 are determined to provide a desired compression ratio within free piston engine 10 and output work from free piston engine 10 (block 140). A variable TIME is then set to zero (block 142) and high pressure check valve HPC is opened using high pressure pilot valve HPP to connect high pressure hydraulic accumulator H with pressure chamber 50 (block 144). A wait state then occurs until the variable TIME is greater than or equal to the high pressure pulse width time $HP_{pul}$ which was determined in block 140 (decision block 146 and line 148).

After the high pressure pulse is injected into pressure chamber 50 (line 150), high pressure check valve HPC is deactuated and pressure chamber 50 is decoupled from high pressure hydraulic accumulator H (block 152).

Blocks 154 and 156, decision block 158 and return line 160 correspond to a fuel injection timing sequence which is used to inject fuel into combustion chamber 28. At block 154, the variable TIME which is still being continuously incremented using a known timer circuit or the like is compared with a variable InjStart to determine a point in time at which fuel is injected into combustion chamber 28 using fuel injector 30. Since the variable TIME was initially set to zero at the beginning of a compression stroke prior to injecting the high pressure pulse, the variable InjStart corresponds to a point in time at which piston 14 should be at a proper location for injecting fuel into combustion chamber 28. The variable InjStart may be empirically or theoretically determined, and is preferably empirically determined for a specifically configured free piston engine in the embodiment shown. After the variable TIME becomes equal to or just slightly larger than the variable InjStart, fuel injector 30 is actuated to inject a predetermined load of fuel into combustion chamber 28 (block 156). The variable TIME is then compared with a variable InjEnd corresponding to a point in time relative to the beginning of the compression stroke at which fuel injector 30 is deactuated. If the variable TIME is not greater than or equal to the variable InjEnd (line 160), then a wait state occurs during which fuel injector 30 is held open and control passes back to block 154. On the other hand, when the variable TIME becomes equal to or just slightly larger than the variable InjEnd (line 162), then the fuel injector 30 is deactuated (block 164).

As piston 14 travels past the TDC position and begins a return stroke towards the BDC position, the pressure within pressure chamber 50 begins to increase and low pressure check valve LPC closes and high pressure check valve HPC opens as a result of the increasing pressure (block 168). After high pressure check valve HPC opens, high pressure pilot valve HPP is opened (block 170) to maintain high pressure check valve HPC in an open state. The point in time at which high pressure pilot valve HPP is opened is based upon a value of the still increasing variable TIME, and is selected with a slight delay period so that it is assured that high pressure check valve HPC has already opened.

Decision blocks 172 and 174, and line 176, correspond to a wait state that occurs to assure that combustion has occurred within combustion chamber 28 of free piston engine 10. If combustion does not occur, the energy input into free piston engine 10 is not sufficient to cause piston 14 to return to a location at or near a BDC position resulting in actuation of piston sensor S (block 172). If sensor S has not been actuated (line 178), then the still increasing variable TIME is compared with a variable $T_{mis}$ corresponding to a predetermined threshold value indicating that a misfire has occurred (block 174). If the sensor S has not yet been actuated, but the variable TIME still does not indicate that a misfire has occurred (line 176), then control passes back to decision block 158 and the wait state repeats. On the other hand, if sensor S has not been actuated and the variable TIME is indicative of a misfire (line 180), then control passes to a misfire procedure, which will be described in greater detail hereinafter with reference to FIG. 6 (block 182).

If combustion occurs within combustion chamber 28 and sensor S is actuated in a predetermined amount of time (line 184), then piston 14 is at or near a BDC position. A variable bounce time BT is set to zero (block 186), and a wait state occurs at decision block 188, block 190 and return line 192. This wait state corresponds to a period of time during which sensor S initially went high as piston 14 travels towards a BDC position and subsequently when sensor S goes low as piston 14 bounces back toward the TDC position. After sensor 14 goes high (decision block 172), the variable bounce time BT is set to zero (block 186). A determination is then made as to whether piston 14 has bounced back toward the TDC position a sufficient distance to cause sensor S to go low (decision block 188). If sensor S is still high, then the variable BT is incremented by one and control passes back to the input side of decision block 188 via line 192.

When sensor S goes low, indicating that piston 14 has bounced back toward the TDC position a predetermined distance corresponding to the placement of sensor S (line 194), the valuable of the variable BT is examined to determine whether the fuel needs to be increased or decreased (block 196). More particularly, the period of time between when sensor S originally goes high and subsequently goes low corresponds to the distance which piston 14 travels past sensor S. If a larger amount of fuel is combusted within combustion chamber 28, piston 14 travels further past sensor S to a BDC position which is further from the TDC position. Consequently, the period of time between when sensor S goes high and subsequently goes low is greater. On the other hand, if a smaller amount of fuel is combusted within combustion chamber 28, piston 14 will travel a smaller distance past sensor S to a BDC position which is closer to the TDC position. Consequently, the period of time between when sensor S goes high and subsequently goes low is smaller.

From the foregoing, it may be understood that the period of time between when sensor S goes high and subsequently goes low, represented by the value of the variable bounce time BT, can be used as an approximation of an amount of fuel which is necessary during the combustion process within combustion chamber 28. If the value of the variable BT is greater than a threshold $BT_{set}$, then the amount of fuel which will be injected into combustion chamber 28 during a next compression stroke is decreased by a preset amount. Conversely, if the value of the variable BT is less than a threshold value of $BT_{set}$, then the amount of fuel which will be injected into combustion chamber 28 during a next compression stroke is increased by a preset amount. By comparing the value of the variable BT with the threshold value $BT_{set}$, and increasing or decreasing the fuel, an optimum load of fuel corresponding to a maximum efficiency of free piston engine 10 is loaded into combustion chamber 28 during each cycle.

After the quantity of fuel which is to be loaded during a next compression stroke into combustion chamber 28 has been determined, control passes via line 198 back to block 136. Free piston engine 10 is then ready to be fired again.

Figure 6:
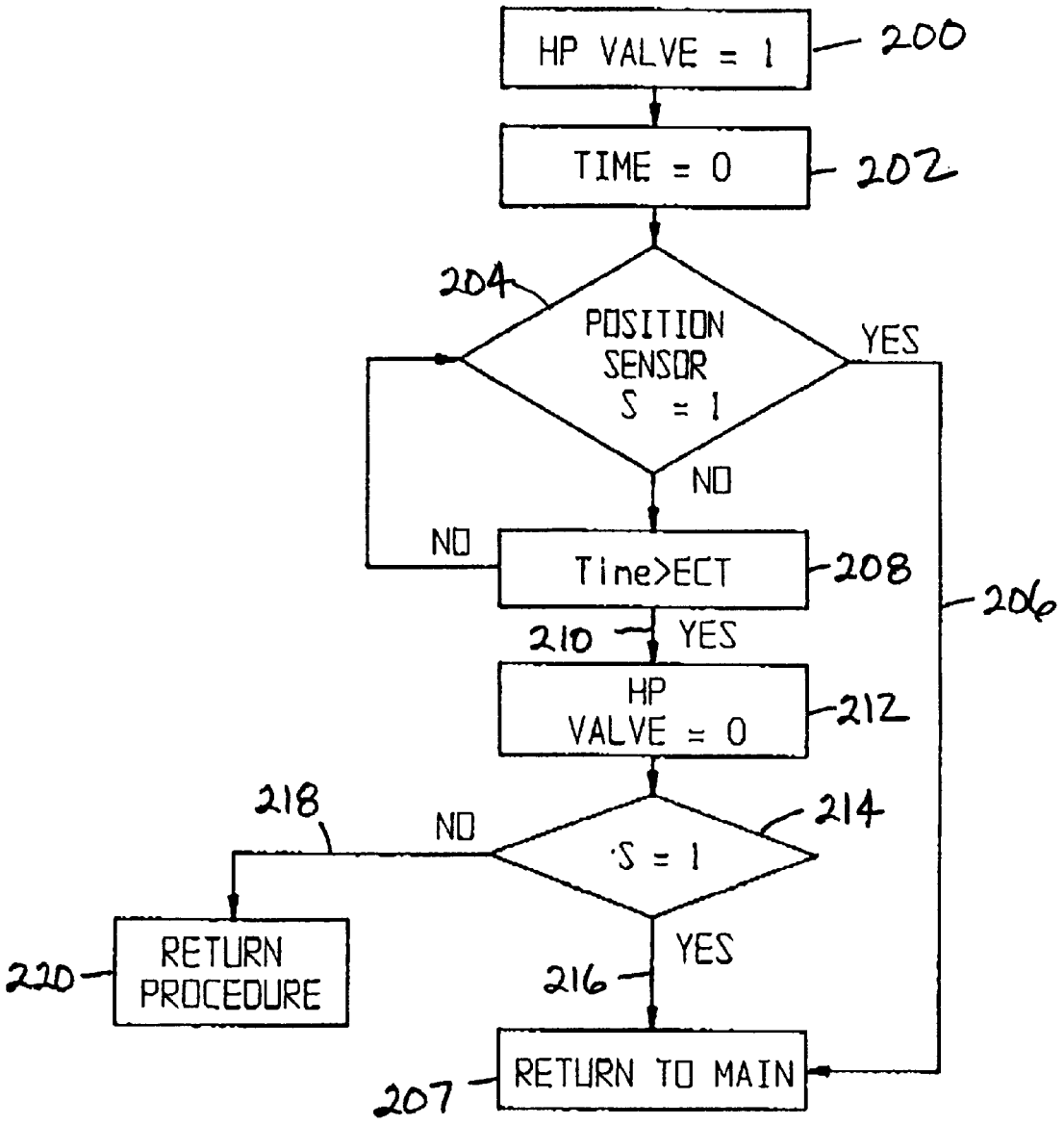
FIG. 6 is a flow chart illustrating an embodiment of a method of the present invention for operation of the free piston engine upon occurrence of a misfire condition designated in FIG. 5.

Referring now to FIG. 6, an embodiment of the method of the present invention for operation of the free piston engine upon occurrence of a misfire condition will be described in greater detail. In the embodiment shown in FIG. 6, the method is assumed to be carried out using free piston engine 10 with hydraulic circuit 16. However, it will be appreciated that the embodiment of the method shown in FIG. 6 is equally applicable to other embodiments of a free piston engine, such as free piston engine 10 using hydraulic circuits 92 or 102 shown in FIGS. 2 and 3.

At block 200, the high pressure valve is set to "1", meaning that high pressure check valve HPC is opened as piston 14 begins traveling toward a BDC position. The variable "time" is set to "0" (block 202) substantially concurrently with the opening of high pressure check valve HPC and is incremented using, e.g., a timer circuit or the like. A wait state then occurs, dependent upon whether piston 14 travels to a position at or near a BDC position and activates position sensor S (decision block 204). When sensor S is activated, the value of sensor S equals "1". During the wait state, the is variable "time" is incremented and compared with a constant value representing a maximum threshold limit for an extended combustion time (ECT; block 208). If the position sensor is activated before the variable TIME exceeds the constant ECT (line 126), then the misfire was only temporary and control passes back to the main control routine for normal operation of free piston engine 10 (block 207). On the other hand, if the position sensor was not activated and the variable TIME becomes greater than the constant ECT (block 208 and line 210), then free piston engine 10 did not recover from the misfire and the high pressure valve is turned OFF (block 212). A final check is again made to determine whether piston 14 moved to a position at or near a BDC position such that position sensor S was activated (decision block 214). If sensor S was activated, then free piston engine 10 may again be fired and control passes back to the main control routine (line 216). On the other hand, if position sensor S is still not activated (line 218), then a manual return procedure is initiated, as described above in further detail.

Industrial Applicability

During use, a fuel and air mixture is loaded into combustion chamber 28 of a free piston engine 10, 90 or 100. A high pressure pulse of high pressure hydraulic fluid is introduced into pressure chamber 50 from high pressure hydraulic accumulator H. The pulse of high pressure hydraulic fluid causes piston 14 to move toward a TDC position with enough kinetic energy to effect combustion within combustion chamber 28. After the pulse of high pressure hydraulic fluid is applied to pressure chamber 50, the fluid connection with high pressure hydraulic accumulator H is closed and the fluid connection with low pressure hydraulic accumulator L is opened. The expanding volume within pressure chamber 50 is filled with a lower pressure hydraulic fluid during the remainder of the compression stroke. During the return stroke, the fluid connection with low pressure hydraulic accumulator L is closed and the fluid connection with high pressure hydraulic H is opened. Movement of hydraulic plunger 46 toward the BDC position causes high pressure hydraulic fluid to be pumped into high pressure hydraulic accumulator H, thereby resulting in a net positive gain in the pressure within high pressure hydraulic accumulator H. The high pressure hydraulic fluid generated within high pressure hydraulic accumulator H can be used for any suitable application, such as a power source for a hydrostatic transmission.

Other aspects, objects and advantages of this invention can be obtained from a study of the drawings, the disclosure and the appended claims.

What is claimed is:

1. A method of operating a free piston internal combustion engine, comprising the steps of:

providing a housing including a combustion cylinder and a hydraulic cylinder;

providing a piston including a piston head reciprocally disposed within said combustion cylinder, a plunger head reciprocally disposed within said hydraulic cylinder, and a plunger rod interconnecting said piston head with said plunger head, said plunger head and said hydraulic cylinder defining a variable volume pressure chamber on a side of said plunger head generally opposite said plunger rod;

pulsing a supply of hydraulic fluid from a high pressure hydraulic accumulator into said pressure chamber during a beginning portion of a compression stroke to cause said piston head to move toward a top dead center position;

decoupling said high pressure hydraulic accumulator from said pressure chamber; and coupling a low pressure hydraulic accumulator with said pressure chamber during a remaining portion of said compression stroke, thereby allowing a relatively lower pressure hydraulic fluid to flow into said hydraulic cylinder as said piston head moves toward said top dead center position.

2. The method of claim 1, wherein said pulsing step comprises pulsing said hydraulic fluid from said high pressure hydraulic accumulator into said pressure chamber at a pressure of between 20000 and 40000 kilopascals for a period of approximately between 1 and 10 milliseconds.

3. The method of claim 2, wherein said pulsing step comprises pulsing said hydraulic fluid from said high pressure hydraulic accumulator into said pressure chamber at a pressure of between 20000 and 40000 kilopascals for a period of approximately between 5 and 6 milliseconds.

4. The method of claim 3, wherein said pulsing step comprises pulsing said hydraulic fluid from said high pressure hydraulic accumulator into said pressure chamber at a pressure of approximately 30000 kilopascals for a period of approximately 5.3 milliseconds.

5. The method of claim 1, wherein said supply of hydraulic fluid is pulsed into said pressure chamber from said high pressure hydraulic accumulator with enough potential energy to cause said piston head to move with enough kinetic energy to effect spontaneous combustion within said combustion cylinder.

6. The method of claim 1, wherein said pulsing step comprises the substep of selectively actuating a valve to interconnect said high pressure hydraulic accumulator with said pressure chamber during said beginning portion of said compression stroke.

7. The method of claim 6, wherein said valve comprises a high-speed pilot operated check valve.

8. The method of claim 1, comprising the further step of interconnecting said pressure chamber with said high pressure hydraulic accumulator during substantially all of a return stroke using a valve.

9. The method of claim 8, wherein said valve comprises a pilot operated check valve including a pilot valve and a check valve, said check valve automatically opening during a beginning portion of said return stroke, said pilot valve being selectively actuatable to hold said check valve open during substantially all of said return stroke.

10. The method of claim 1, comprising the further step of sensing a position of said piston with a sensor when said piston is one of at and near said bottom dead center position.

11. The method of claim 10, comprising the further step of determining whether combustion has occurred in said combustion cylinder, dependent upon said sensed position of said piston.

12. The method of claim 10, comprising the further step of determining whether a misfire has occurred, dependent upon said sensed position of said piston.

13. The method of claim 10, comprising the further step of determining a period of time during which said sensor is high.

14. The method of claim 13, comprising the further step of repeating said pulsing step, after said sensor goes low.

15. The method of claim 14, comprising the further step of injecting a predetermined load of fuel into said combustion chamber, said predetermined load of fuel being dependent upon said period of time that said sensor is high.

16. The method of claim 15, wherein said predetermined load of fuel corresponds to a magnitude of bounce of said piston after said sensor goes high.

* * * * *